US006924448B2

(12) United States Patent
Sera et al.

(10) Patent No.: US 6,924,448 B2
(45) Date of Patent: Aug. 2, 2005

(54) MOVABLE CONTACT UNIT WITH OPERATING PROJECTIONS, METHOD OF MOUNTING OPERATING PROJECTIONS AND OPERATING PANEL SWITCH USING MOVABLE CONTACT UNIT WITH OPERATING PROJECTIONS

(75) Inventors: Naoki Sera, Okayama (JP); Masahiro Ito, Okayama (JP); Nobuhiro Numoto, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 64 days.

(21) Appl. No.: 10/727,928

(22) Filed: Dec. 3, 2003

(65) Prior Publication Data

US 2004/0154912 A1 Aug. 12, 2004

(30) Foreign Application Priority Data

Dec. 4, 2002 (JP) ..... 2002-352395

(51) Int. Cl.[7] ..... H01H 13/70

(52) U.S. Cl. ..... 200/516; 200/406; 200/512; 200/517; 29/622

(58) Field of Search ..... 200/5 A, 406, 200/512, 516, 517; 341/22; 400/490–496; 345/168, 169; 29/622

(56) References Cited

U.S. PATENT DOCUMENTS

| | | | | | |
|---|---|---|---|---|---|
| 5,924,555 | A | * | 7/1999 | Sadamori et al. | 200/512 |
| 6,369,801 | B2 | * | 4/2002 | Boireau et al. | 345/169 |
| 6,388,518 | B1 | * | 5/2002 | Miyatani | 330/149 |
| 6,492,602 | B2 | * | 12/2002 | Asai et al. | 200/1 B |
| 6,743,994 | B2 | * | 6/2004 | Adachi | 200/512 |

FOREIGN PATENT DOCUMENTS

JP 2002-216582 8/2002

* cited by examiner

*Primary Examiner*—Michael A. Friedhofer
(74) *Attorney, Agent, or Firm*—RatnerPrestia

(57) ABSTRACT

Parts of a base film that correspond to respective movable contacts are formed into projections. Operating projections each including a projecting member fixed to a top surface of the base film by an adhesive resin are formed and correspond to the movable contacts, respectively. The adhesive resins have different fixed diameters.

10 Claims, 5 Drawing Sheets

MOVABLE CONTACT UNIT WITH OPERATING PROJECTIONS, METHOD OF MOUNTING OPERATING PROJECTIONS AND OPERATING PANEL SWITCH USING MOVABLE CONTACT UNIT WITH OPERATING PROJECTIONS

FIELD OF THE INVENTION

The present invention relates to a movable contact unit with operating projections that is used, for example, in operating panels of a variety of electronic apparatuses, and also relates to a method of mounting the operating projections, and an operating panel switch using the movable contact unit with the operating projections.

BACKGROUND OF THE INVENTION

Recently, as portable electronic apparatuses have increased in number, a variety of electronic apparatuses have become compact and lightweight. An operating panel switch for the electronic apparatus is low-profile and affords a good click feel and an electrically stable contact, so that a so-called movable contact unit, the insulating resin film of which holds a plurality of separate domed movable contacts formed out of an electrically conductive and resilient metal plate, has found wide use.

To improve operability, the operating panel switch is demanded of an arrangement of keys corresponding to respective switches intended to afford different click feels.

Referring to FIGS. 7–9, a description will be provided hereinafter of a conventional movable contact unit with operating projections that is disclosed in Japanese Patent Laid Open No. 2002-216582.

FIG. 7 is a sectional view of the conventional movable contact unit with the operating projections. Base film 1 is a flexible film of insulating resin. A plurality of domed movable contacts 3 formed out of electrically conductive and resilient sheet metal is bonded to a bottom surface of base film 1 by adhesive layer 2. Separator 4 formed of an insulating film is bonded to the whole bottom surface of base film 1 across movable contacts 3 by adhesive layer 2. The surface of separator 4 is processed for ease of removal. Separator 4 thus formed prevents movable contacts 3 from corroding and also prevents foreign matter from adhering to adhesive layer 2 during transportation and storage.

A plurality of projecting members 5A is each fixed to base film 1 by adhesive resin 5B. These projecting members 5A are formed by stamping a film of resin into cylindrical shapes and hence are circular when viewed from above. Projection member 5A and adhesive resin 5B form operating projection 5.

FIG. 8 shows the thus-constructed movable contact unit with the operating projections that is mounted to an apparatus.

When the movable contact unit with the operating projections is mounted to the apparatus, separator 4 is removed, and base film 1 is bonded to wiring board 7 by adhesive layer 2. Respective central portions of movable contacts 3 each face corresponding central fixed contact 6A across a given clearance, while respective lower borders of movable contacts 3 are each placed on corresponding outer fixed contact 6B. Movable contact 3 and corresponding fixed contact 6 form one switch. Above each operating projection 5, operating button 8 of the apparatus is disposed.

Referring to FIG. 9, a description will be provided next of operation of an operating panel switch using the thus-constructed conventional movable contact unit with the operating projections.

When pressed, operating button 8 moves downward, and downward pushing force is applied accordingly to an upper end of cylindrical projecting member 5A contacting bottom surface 8A of operating button 8. In other words, the pushing force is applied to the central portion of movable contact 3 via projecting member 5A and base film 1. When this pushing force becomes greater than shape retaining force of movable contact 3, domed movable contact 3 is turned inside out while providing the click feel, whereby a bottom surface of its central portion contacts central fixed contact 6A. As a result, central fixed contact 6A and outer fixed contact 6B of wiring board 7 are electrically coupled to each other via movable contact 3.

When released from the pushing force, movable contact 3 restores its original shape with its own resilient restoring force, so that the bottom surface of its central portion departs from central fixed contact 6A. This means that central fixed contact 6A and outer fixed contact 6B of wiring board 7 return to a state in which these contacts 6A, 6B are electrically isolated from each other.

To set operating force (corresponding to the above-mentioned pushing force), which acts on a specified movable contact of the plurality of movable contacts 3, different from operating force which acts on another movable contact of the above-constructed conventional movable contact unit, the following methods are generally conceivable.

EXAMPLE 1

The specified movable contact is set different from other movable contacts in diameter, thickness or material.

EXAMPLE 2

The operating projection corresponding to the specified movable contact is set different from other operating projections in shape or material.

The above-mentioned examples, however, increase the variety of elements to be used and complicate a manufacturing process, thus increasing costs.

SUMMARY OF THE INVENTION

The present invention addresses the conventional problems discussed above and aims to provide a movable contact unit with operating projections that facilitates setting of desired operating force which acts on a specified movable contact without increasing the variety of elements to be used and also aims to provide a method of mounting the operating projections and an operating panel switch using the movable contact unit with the operating projections.

The movable contact unit with the operating projections of this invention includes:

a plurality of domed movable contacts opening downward, the movable contacts formed out of electrically conductive and resilient sheet metal;

a base film holding the movable contacts in place at a bottom surface thereof; and a plurality of projecting members fixed to a top surface of the base film by an adhesive to correspond to the respective movable contacts, each of the projecting members facing a central portion of the corresponding movable contact across the base film, wherein the amount of adhesive fixing a specified projecting member of the plurality of projecting members to the base film differs from the amount of adhesive fixing another projecting member.

The method of mounting the operating projections according to this invention includes the steps of:

(a) forming an adhesive into a first adhesive layer having a uniform thickness;

(b) preparing an in-process workpiece including a specified arrangement of a plurality of movable contacts held to a bottom surface of a base film by a second adhesive layer;

(c) causing the adhesives to adhere to respective leading end parts of a plurality of transfer pins, arranged to correspond to the specified arrangement of the movable contacts, by:

(c1) lowering the leading end parts into the first adhesive layer; and (c2) raising the transfer pins;

(d) transferring the adhesives, which have adhered to the respective leading end parts of the transfer pins in the step (c), to a top surface of the base film with each of the adhesives corresponding to a central portion of the corresponding movable contact;

(e) placing projecting members on the respective adhesives transferred; and (f) curing the adhesives, wherein a specified transfer pin of the plurality of transfer pins differs from another transfer pin in one of shape and size so that the amount of adhesive adhering to the specified transfer pin differs from the amount of adhesive adhering to another transfer pin.

The operating panel switch of this invention includes:

a plurality of domed movable contacts opening downward, the movable contacts formed out of electrically conductive and resilient sheet metal;

a base film formed with an adhesive layer at a bottom surface thereof, the base film holding the movable contacts in place by means of the adhesive layer;

a plurality of projecting members fixed to a top surface of the base film by an adhesive to correspond to the respective movable contacts, each of the projecting members facing a central portion of the corresponding movable contact across the base film; and a wiring board including a plurality of fixed contacts arranged to face the movable contacts, respectively, wherein the amount of adhesive fixing a specified projecting member of the plurality of projecting members to the base film differs from the amount of adhesive fixing another projecting member, and the base film is bonded to the wiring board by the adhesive layer.

DETAILED DESCRIPTION OF THE EXEMPLARY EMBODIMENTS

An exemplary embodiment of the present invention is demonstrated hereinafter with reference to FIGS. 1–6.

Figure 1:
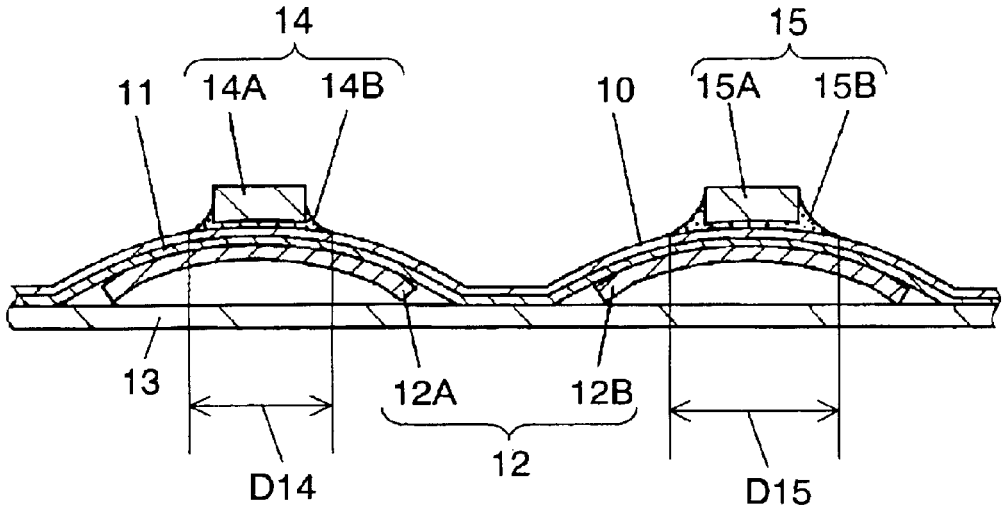
FIG. 1 is a sectional view of a movable contact unit with operating projections in accordance with an exemplary embodiment of the present invention.

FIG. 1 is a sectional view of a movable contact unit with operating projections in accordance with the embodiment of this invention. In FIG. 1, base film 10 is a flexible film of insulating resin. Adhesive layer (second adhesive layer) 11 is formed on the whole bottom surface of base film 10, and holds top surfaces of a plurality of domed movable contacts 12 (12A, 12B) disposed in place. Separator 13 formed of a film of insulating resin is bonded to the bottom surface of base film 10 across movable contacts 12 by adhesive layer 11 to cover the whole surface of base film 10. Separator 13 is surface treated for ease of later removal.

Parts of base film 10 that correspond to respective movable contacts 12 (12A, 12B) are each formed into a shape matching the domed shape of movable contact 12.

Projecting members 14A, 15A are fixed to a top surface of base film 10 by respective adhesive resins 14B, 15B to correspond to respective central portions of movable contacts 12 (12A, 12B). Projecting member 14A and adhesive resin 14B form operating projection 14, while projecting member 15A and adhesive resin 15B form operating projection 15. Projecting members 14A, 15A are formed by stamping an elastic film of resin having uniform quality and a uniform thickness into cylindrical shapes of the same diameter. Cylindrical projecting member 14A has one circular end face and a curved side fixed to base film 10 by adhesive resin 14B, and similarly, cylindrical projecting member 15A has one circular end face and a curved side fixed to base film 10 by adhesive resin 15B.

With projecting members 14A, 15A fixed, the area (or the amount) of adhesive resin 14B differs from the area (the amount) of adhesive resin 15B on base film 10. In other words, adhesive resin 14B is formed to have fixed diameter D14 differing from fixed diameter D15 of adhesive resin 15B.

It is to be noted that, for example, the material for projecting members 14A, 15A and material for adhesive resins 14B, 15B are not limited. However, in cases where an ultraviolet curing adhesive is used for adhesive resins 14B, 15B, as will be described later, projecting members 14A, 15B preferably use a film of resin which passes not less than 70% of all light including ultraviolet light for curing the adhesive.

Figure 2:
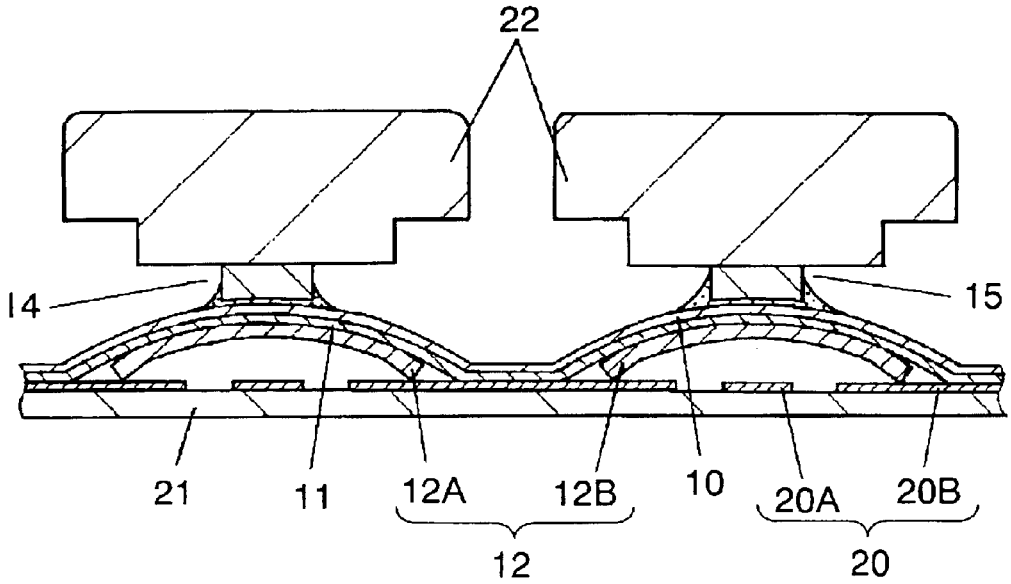
FIG. 2 is a sectional view illustrating the movable contact unit mounted to an apparatus.

In the present embodiment, movable contacts 12A, 12B are made of the same material and have the same shape, and projecting members 14A, 15A are made of the same material and have the same shape FIG. 2 is a sectional view illustrating the above-mentioned movable contact unit with the operating projections that is mounted to an apparatus. When this movable contact unit with the operating projections is mounted to the apparatus, separator 13 shown in FIG. 1 is removed from the movable contact unit. Thereafter, the movable contact unit with the operating projections is bonded to wiring board 21 by adhesive layer 11 so that its movable contacts 12 (12A, 12B) each face corresponding fixed contact 20 (20A, 20B). Operating buttons 22 are disposed above operating projections 14, 15, respectively. In this way, an operating panel switch for the apparatus is formed.

As shown in FIG. 2, the central portion of each movable contact 12 faces corresponding central fixed contact 20A across a given clearance, while a lower border of each movable contact 12 is placed on corresponding outer fixed contact 20B. In other words, movable contact 12 and corresponding fixed contact 20 form an individual switch.

Figure 3:
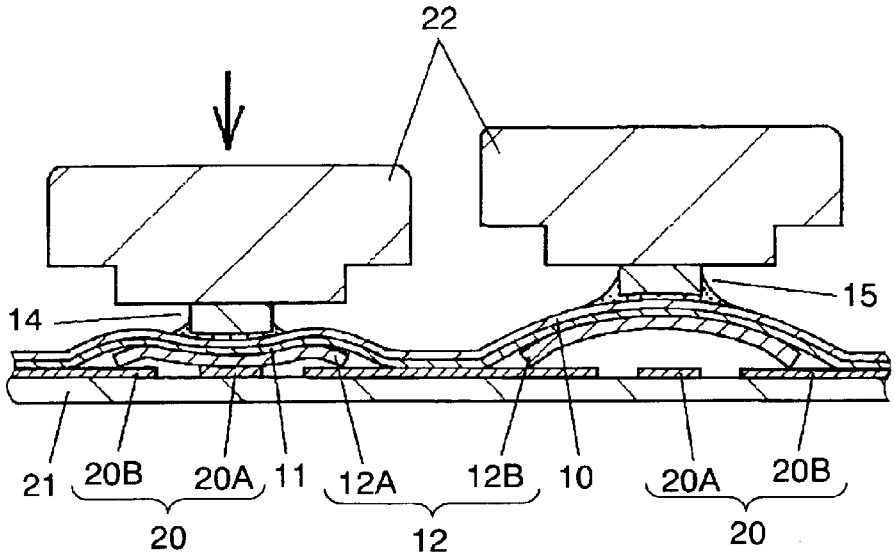
FIG. 3 is a sectional view illustrating the movable contact unit in an operating condition.

When operating button 22 is pressed, pushing force is exerted accordingly on movable contact 12A (12B) via operating projection 14 (15) as shown in FIG. 3. When this pushing force becomes greater than shape retaining force of movable contact 12A (12B), movable contact 12A (12B) is turned inside out, whereby a bottom surface of the central portion of movable contact 12A (12B) contacts central fixed contact 20A. Consequently, electrical conduction is established between central fixed contact 20A and outer fixed contact 20B via movable contact 12A (12B).

As described above, the movable contact unit with the operating projections of the present embodiment uses movable contacts 12A, 12B of the same type and projecting members 14A, 15A of the same type, while adhesive resins 14B, 15B differ from each other in fixed diameter. In other words, as shown in FIG. 1, fixed diameter D15 of adhesive resin 15B of operating projection 15 is larger than fixed diameter D14 of adhesive resin 14B of operating projection 14. Since fixed diameter D15 is larger than fixed diameter D14, the pushing force acting on operating projection 15 extends more to an outer portion of movable contact 12 (12B) than the pushing force which acts on operating projection 14, thus acting on the movable contact. This means that the pushing force which turns movable contact 12B inside out is greater than the pushing force which turns movable contact 12A inside out.

Although movable contacts 12A, 12B of the same type and projecting members 14A, 15A of the same type are used, adhesive resins 14B, 15B can thus cause different operating forces or click feels. In other words, with the variety of elements to be used not increased, the desired click feel can be set for the specified movable contact simply by changing the area of the cured adhesive through adjustment of the amount of adhesive to be applied.

Since the pushing force is applied to the central portion of movable contact 12A or 12B via projecting member 14A or 15A by pressing operating button 22, there are few cases where the click is felt less even when, for example, operating button 22 is placed off-center.

When operating button 22 is released from the pushing force, movable contact 12A (12B) expands upward with its own resilient restoring force and restores its original shape. As a result, the bottom surface of the central portion of movable contact 12A (12B) departs from central fixed contact 20A, whereby central fixed contact 20A and outer fixed contact 20B return to a state in which these contacts 20A, 20B are electrically isolated from each other.

As described above, the movable contact unit with the operating projections of the present embodiment is constructed to have the plurality of movable contacts 12 held to one base film 10, and the operating forces acting on the respective movable contacts during pressing are set in accordance with the respective areas of adhesive resins 14B, 15B bonding the respective projecting members 14A, 15A to base film 10. Since the desired operating force can thus be set for the specified movable contact, an arrangement of keys (or switches) that has favorable operability can be realized easily at low cost without an increase in the number of elements to be used.

In the present embodiment, cylindrical projecting members 14A, 15A have their respective circular end faces and curved sides fixed to base film 10 by respective adhesive resins 14B, 15B. However, those curved sides may not be bonded.

Referring to FIGS. 4–6, a description will be provided next of a method of manufacturing the movable contact unit with the operating projections in accordance with the present embodiment.

Figure 4A:
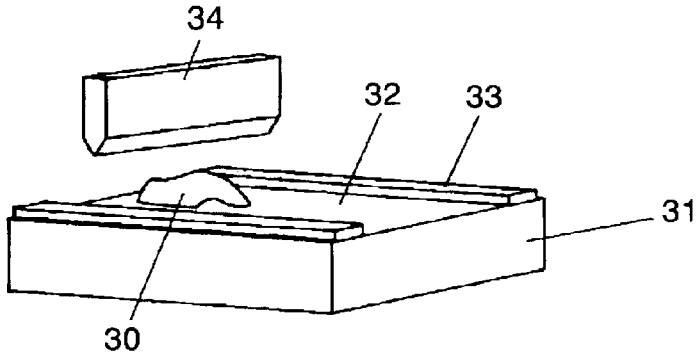
FIG. 4A illustrates a process of preparing an adhesive layer in a method of manufacturing the movable contact unit with the operating projections.

First, a process of preparing an adhesive layer (first adhesive layer) is carried out. In this process, the specified amount of ultraviolet curing adhesive resin 30 is placed on stage 31 as shown in FIG. 4A. Adhesive resin 30 is in the form of yet-to-be-cured paste. Top surface 32 of stage 31 is a smooth plane larger than the movable contact unit to be manufactured, and spacers 33 of the same thickness on both sides of top surface 32.

Figure 4B:
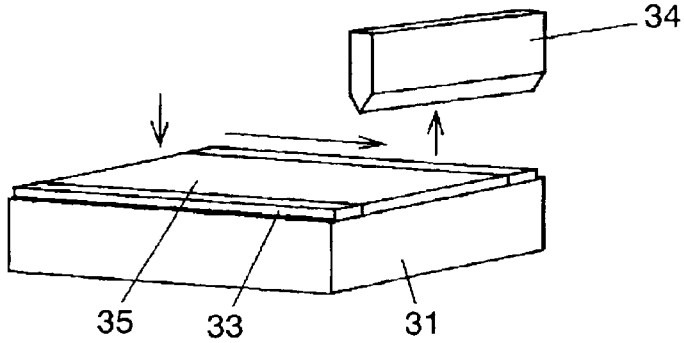
FIG. 4B illustrates the process of preparing the adhesive layer in the method of manufacturing the movable contact unit with the operating projections.

While abutting against spacers 33 of stage 31, squeegee 34 is moved as shown in FIG. 4B to level off adhesive resin 30 placed on top surface 32. Consequently, adhesive resin layer 35 having a uniform thickness (equal to the thickness of spacers 33) is formed.

Figure 5A:
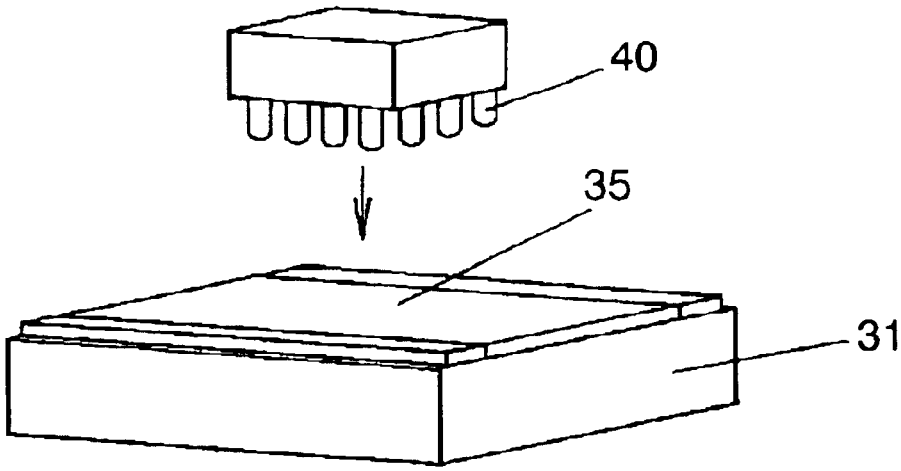
FIG. 5A illustrates a process of preparing transfer in the method of manufacturing the movable contact unit with the operating projections.
Figure 5B:
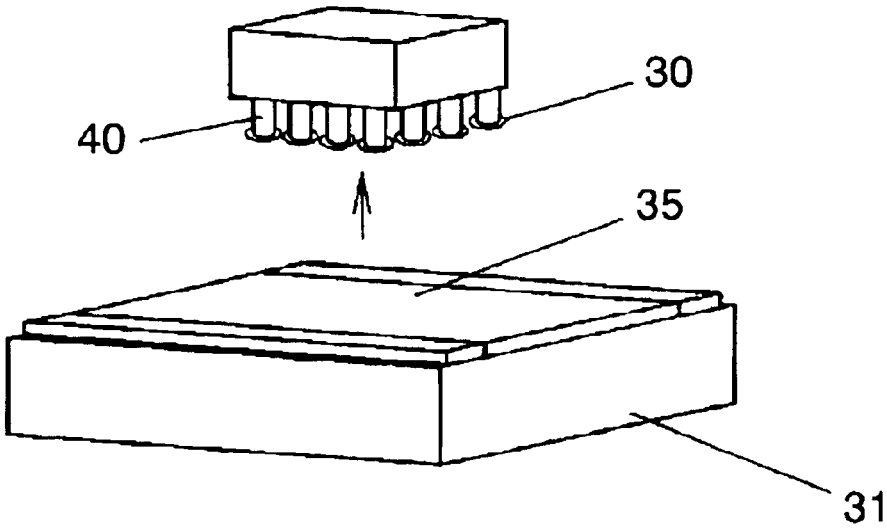
FIG. 5B illustrates the process of preparing transfer in the method of manufacturing the movable contact unit with the operating projections.

Next, a process of preparing transfer is carried out. In this process, a plurality of transfer pins 40 made of metal is lowered from above into adhesive resin layer 35 as shown in FIG. 5A so that their respective leading end parts go down to a certain depth. It is to be noted that the leading end parts of the transfer pins 40 are flattened and each have a bottom surface which is circular but may have any other shape. Subsequently, the transfer pins 40 are raised as shown in FIG. 5B with adhesive resin 30 held to the bottom surface and a side of the leading end part of each transfer pin 40.

The arrangement of transfer pins 40 matches the arrangement of the respective central portions of movable contacts 12 of the movable contact unit to be manufactured. Transfer pins 40 hold some adhesive resin 30 of adhesive resin layer 35 simultaneously.

It is to be noted here that the bottom surface of the leading end part of the transfer pin corresponding to projecting member 15A is larger in area than that of another transfer pin for increased operating force.

Concurrently with the process of preparing the adhesive layer, a process of preparing in-process workpiece 50 is carried out. In-process workpiece 50 made in this process (not shown) includes movable contacts 12 whose top surfaces are held by adhesive layer 11 formed on the bottom surface of base film 10, and separator 13 bonded by adhesive layer 11. Since all those movable contacts 12 used are of the same type, movable contacts 12 are successively bonded to base film 10, so that productivity increases.

Figure 6A:
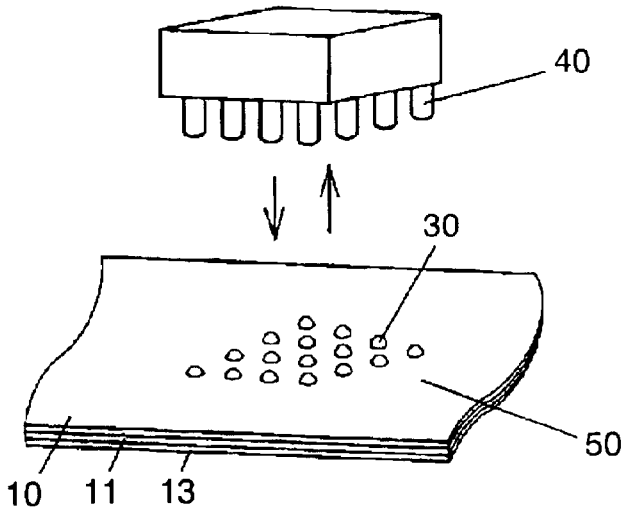
FIG. 6A illustrates a transferring and curing process in the method of manufacturing the movable contact unit with the operating projections.

Next, a transferring and curing process is carried out. In this process, transfer pins 40 each having the specified amount of adhesive resin 30 are pressed against the top surface of base film 10 of in-process workpiece 50 at the same time as shown in FIG. 6A to correspond to the central portions of the movable contacts (not shown), respectively.

As a result, adhesive resins 30 are transferred to base film 10. It is to be noted here that a reference position of in-process workpiece 50 is aligned with a reference position of the arrangement of transfer pins 40 when transfer pins 40 are pressed against base film 10.

Figure 6B:
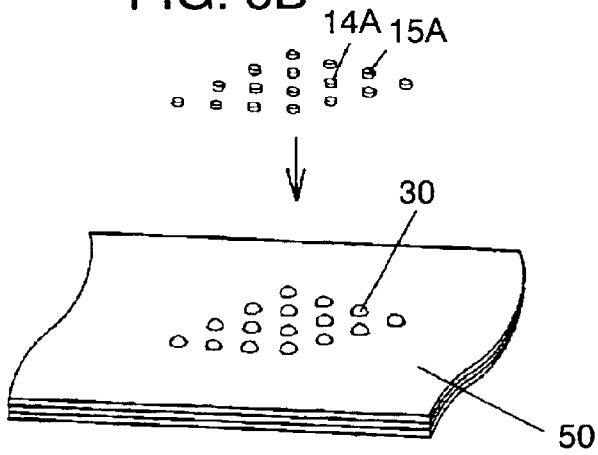
FIG. 6B illustrates the transferring and curing process in the method of manufacturing the movable contact unit with the operating projections.
Figure 7:
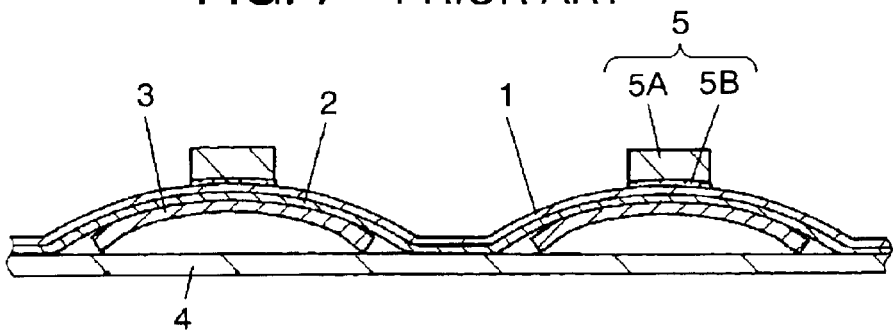
FIG. 7 PRIOR ART
FIG. 7 is a sectional view of a conventional movable contact unit with operating projections.
Figure 8:
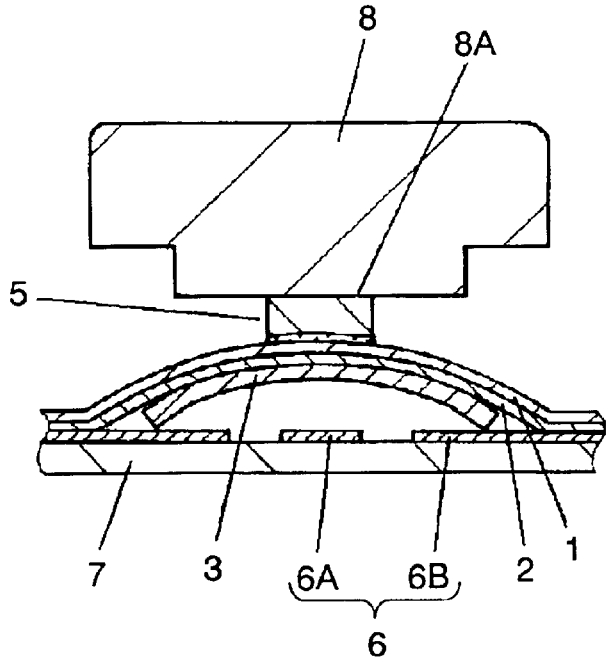
FIG. 8 PRIOR ART
FIG. 8 is a sectional view illustrating the conventional movable contact unit mounted to an apparatus.
Figure 9:
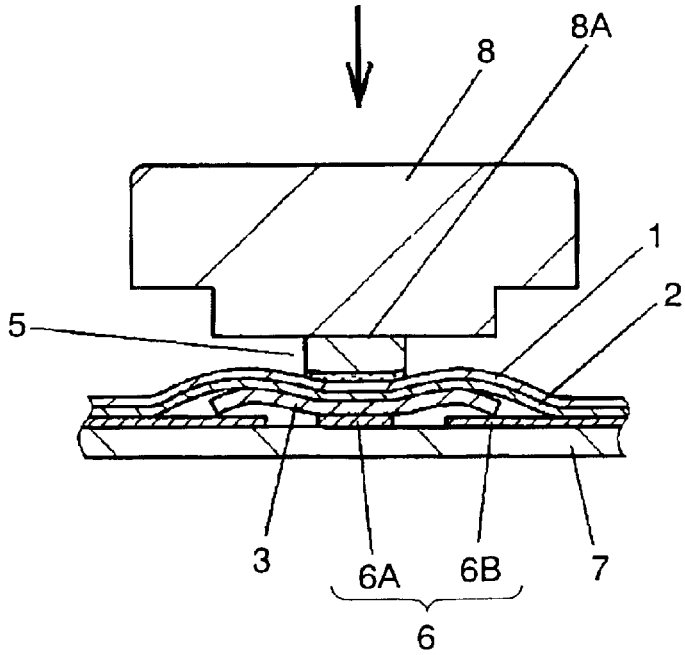
FIG. 9 PRIOR ART
FIG. 9 is a sectional view illustrating the conventional movable contact unit in an operating condition.

Subsequently, as shown in FIG. 6B, projecting members 14A, 15A formed by stamping a film of resin, which passes not less than 70% of all light including ultraviolet light, into cylindrical shapes are placed on respective adhesive resins 30 transferred, which thus hold the respective circular lower end faces of projecting members 14A, 15A. Pressure is thereafter applied to a circular upper end face of each projecting members 14A, 15A to spread adhesive resin 30 around the curved side of projecting member 14A, 15A. At this time, each height of the upper end faces of projecting members 14A, 15A is regulated. Since the large amount of adhesive resin 30 is transferred to correspond to projecting member 15A, this adhesive resin 30 is applied to a larger area of base film 10 than another applied area.

Finally, adhesive resins 30 are cured simultaneously with the ultraviolet light applied above projecting members 14A, 15A. Here, projecting members 14A, 15A transmit the ultraviolet light, so that adhesive resins 30 cure without fail.

Instead of being applied from above, the ultraviolet light may be applied from any other direction, depending on how equipment is installed.

The equipment required here may be simplified. No defective including deformation is produced because base film 10 is unaffected by heat or the like.

As is clear from the above description, the arbitrary adjustment can be made to the operating force which acts on each movable contact by changing the diameter of each transfer pin 40.

In the above-described embodiment, the amount of adhesive to be transferred has been adjusted by changing the diameter of the transfer pin. However, the amount of adhesive to be transferred can be adjusted by changing the length of the transfer pin. For example, the transfer pin corresponding to projecting member 15A is made longer than other transfer pins. In this case, this transfer pin corresponding to projecting member 15A goes down more deeply into the adhesive resin layer than other transfer pins in the process of preparing transfer. In other words, the leading end part of the transfer pin corresponding to projecting member 15A holds more adhesive resin. As a result, advantages similar to those obtained when the diameter is increased can be obtained. In the embodiment, the transfer pins are cylindrical but may have any other shapes.

With the shapes of transfer pins 40 unchanged, a slight adjustment to the operating forces can be made by changing the amount of adhesive resin held by each transfer pin 40 through change of the distance covered by transfer pins 40 when these pins 40 are lowered in the transferring and curing process.

In the embodiment, adhesive resins 30 are transferred to base film 10 holding movable contacts 12. However, these adhesive resins 30 may be transferred to flat base film 10 before movable contacts 12 are held by base film 10. This stabilizes the amount of adhesive resin 30 in transfer or application. In this case, after transfer, the base film is machined into a shape for holding the movable contacts, and movable contacts 12 are thereafter held by the base film.

Similar advantages can be obtained if projecting members 14A, 15A are light-transmitting or semitransparent. The use of especially polyethylene terephthalate (PET), which transmits not less than 85% of all light, allows adhesive resins 30 to cure more favorably. PET is inexpensive and lends itself to stamping, thus increasing the productivity in manufacture of the movable contact unit with the operating projections.

It is preferable that pressure applied for transferring adhesive resin 30 to transfer pin 40, pressure applied for transferring adhesive resin 30 to base film 10, and the pressure applied for holding projecting members 14A, 15A to respective adhesive resins 30 each range from 0.5 to 3 N for each transfer pin 40. With an applied pressure less than 0.5 N, adhesive resin 30 is inadequately transferred, and with an applied pressure more than 3 N, adhesive resin 30 spreads more than necessary. If the applied pressure is within the above range, there are few cases where projecting members 14A, 15A lean, and the heights and positions of projecting members 14A, 15A stabilize.

It is to be noted that instead of the pressurization and transfer system using transfer pins 40, a device such as a dispenser may be employed for applying adhesive resin 30. In this case, the amount of adhesive resin to be applied may be controlled by changing discharge time or discharge pressure.

In-process workpiece 50 may be integrally formed, and the base film or separator may be in the form of a hoop. With the base film or separator in hoop form, the productivity increases, and the movable contact unit with the operating projections can be manufactured at lower cost with ease.

What is claimed is:

1. A movable contact unit with operating projections, comprising:

a plurality of domed movable contacts opening downward, the movable contacts formed out of electrically conductive and resilient sheet metal;

a base film holding the movable contacts in place at a bottom surface thereof; and a plurality of projecting members fixed to a top surface of the base film by an adhesive to correspond to the respective movable contacts, each of the projecting members facing a central portion of the corresponding movable contact across the base film, wherein the amount of adhesive fixing a specified projecting member of the plurality of projecting members to the base film differs from the amount of adhesive fixing another projecting member.

2. The movable contact unit of claim 1, further comprising:

an adhesive layer above the bottom surface of the base film, wherein the plurality of movable contacts are held by the adhesive layer.

3. The movable contact unit of claim 1, wherein the adhesive fixing the specified projecting member and the adhesive fixing another projecting member differ from each other in diameter when cured.

4. The movable contact unit of claim 1, wherein the plurality of movable contacts is formed to be turned inside out by similar operating forces, respectively.

5. The movable contact unit of claim 1, wherein:

the plurality of projecting members is formed out of a film of resin which passes not less than 70% of light; and the adhesive is an adhesive resin which cures with ultraviolet light.

6. A method of mounting operating projections of a movable contact unit, the method comprising the steps of:

(a) forming an adhesive into a first adhesive layer having a uniform thickness;

(b) preparing an in-process workpiece including a specified arrangement of a plurality of movable contacts held to a bottom surface of a base film by a second adhesive layer;

(c) causing the adhesives to adhere to respective leading end parts of a plurality of transfer pins, arranged to correspond to the specified arrangement of the movable contacts, by:

(c1) lowering the leading end parts into the first adhesive layer; and (c2) raising the transfer pins;

(d) transferring the adhesives, which have adhered to the respective leading end parts of the transfer pins in the step (c), to a top surface of the base film with each of the adhesives corresponding to a central portion of the corresponding movable contact;

(e) placing projecting members on the respective adhesives transferred; and (d) curing the adhesives, wherein a specified transfer pin of the plurality of transfer pins differs from another transfer pin in one of shape and size so that the amount of adhesive adhering to the specified transfer pin differs from the amount of adhesive adhering to another transfer pin.

7. The method of claim 6, wherein:

the plurality of transfer pins is cylindrical; and the specified transfer pin differs from another transfer pin in diameter.

8. The method of claim 6, wherein the specified transfer pin differs from another transfer pin in length.

9. The method of claim 6, wherein:

the adhesive is an adhesive resin which cures with ultraviolet light;

the projecting members are formed out of one of a light-transmitting film of resin and a semitransparent film of resin; and in the step (f), the adhesive resins transferred are cured by the ultraviolet light applied above the projecting members.

10. An operating panel switch comprising:

a plurality of domed movable contacts opening downward, the movable contacts formed out of electrically conductive and resilient sheet metal;

a base film formed with an adhesive layer at a bottom surface thereof, the base film holding the movable contacts in place by means of the adhesive layer;

a plurality of projecting members fixed to a top surface of the base film by an adhesive to correspond to the respective movable contacts, each of the projecting members facing a central portion of the corresponding movable contact across the base film; and a wiring board including a plurality of fixed contacts arranged to face the movable contacts, respectively, wherein the amount of adhesive fixing a specified projecting member of the plurality of projecting members to the base film differs from the amount of adhesive fixing another projecting member, and the base film is bonded to the wiring board by the adhesive layer.

* * * * *